US008828097B2

(12) United States Patent
Eagles

(10) Patent No.: US 8,828,097 B2
(45) Date of Patent: Sep. 9, 2014

(54) INDUSTRIAL TEXTILE FABRIC

(75) Inventor: Dana Eagles, Sherborn, MA (US)

(73) Assignee: Albany International Corp., Albany, NY (US)

( * ) Notice: Subject to any disclaimer, the term of this patent is extended or adjusted under 35 U.S.C. 154(b) by 313 days.

(21) Appl. No.: 12/613,223

(22) Filed: Nov. 5, 2009

(65) Prior Publication Data

US 2010/0043188 A1 Feb. 25, 2010

Related U.S. Application Data

(62) Division of application No. 10/717,859, filed on Nov. 19, 2003.

(51) Int. Cl.

| | |
|---|---|
| ***B32B 5/02*** | (2006.01) |
| ***D04H 3/07*** | (2012.01) |
| ***D04H 3/14*** | (2012.01) |
| ***D21F 1/00*** | (2006.01) |
| ***D21F 7/08*** | (2006.01) |
| ***D21F 7/10*** | (2006.01) |

(52) U.S. Cl.

CPC ..... *D21F 7/083* (2013.01); *D21F 1/0036* (2013.01); *D21F 1/0063* (2013.01); *D21F 1/0072* (2013.01); *D21F 1/0027* (2013.01); *D21F 7/10* (2013.01); *D21F 1/0054* (2013.01); *Y10S 162/90* (2013.01); *Y10S 162/904* (2013.01)

USPC ..... 8/115.51; 162/358.1; 162/358.2; 162/900; 162/904; 442/50

(58) Field of Classification Search

USPC ..... 8/115.51; 162/358.1; 442/50

See application file for complete search history.

(56) References Cited

U.S. PATENT DOCUMENTS

| | | | |
|---|---|---|---|
| 3,097,413 | A | 7/1963 | Draper, Jr. |
| 4,495,680 | A | 1/1985 | Beck |
| 4,594,756 | A | 6/1986 | Beck |
| 4,740,409 | A | 4/1988 | Lefkowitz |
| 5,330,604 | A | 7/1994 | Allum et al. |
| 5,342,486 | A | 8/1994 | Jeffery et al. |
| 5,360,656 | A | 11/1994 | Rexfelt et al. |
| 5,888,915 | A | 3/1999 | Denton et al. |
| 6,162,518 | A | 12/2000 | Korfer |
| 6,402,895 | B1 | 6/2002 | Best |
| 6,491,794 | B2 | 12/2002 | Davenport |
| 2002/0139503 | A1 | 10/2002 | Davenport |

FOREIGN PATENT DOCUMENTS

| | | |
|---|---|---|
| EP | 0 354 743 A | 2/1990 |
| GB | 1252745 A | 11/1971 |
| GB | 2 202 873 A | 10/1988 |

*Primary Examiner* — Gregory R Delcotto

*Assistant Examiner* — Preeti Kumar

(74) *Attorney, Agent, or Firm* — Frommer Lawrence & Haug LLP; Ronald R. Santucci

(57) ABSTRACT

A method for forming an industrial textile product by spiral winding an array of machine direction (MD) yarns to form a system having a defined width, and then connecting the MD yarns in the cross machine (CD) direction with resin. This method is a replacement for conventional weaving or knitting of substrates which can be used as forming, press or dryer fabrics in papermaking, and other industrial applications. Devices for forming the product are also described.

25 Claims, 4 Drawing Sheets

PINS IN VERTICAL POSITION BEFORE ROTATION INTO HORIZONTAL POSITION

MOST PINS IN HORIZONTAL POSITION WITH LAST PINS IN VERTICAL POSITION

INDUSTRIAL TEXTILE FABRIC

This is a division of U.S. patent application Ser. No. 10/717,859 filed Nov. 19, 2003 entitled "Industrial Textile Fabric", the disclosure of which is incorporated herein by reference.

FIELD OF THE INVENTION

The present invention is directed towards industrial fabrics. More particularly, the invention relates to spirally winding an array of yarns and connecting the yarns in the CD direction with resin.

The invention further relates to a replacement for conventional weaving or knitting of substrates for endless or seamed industrial fabrics, such as those used in the forming, pressing or dryer sections of a papermaking machine. However, the invention is also useful for industrial fabrics in applications other than papermaking.

BACKGROUND OF THE INVENTION

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

It should be recalled that, at one time, industrial fabrics used in papermaking were supplied only in endless form. This is because a newly formed cellulosic fibrous web is extremely susceptible amongst other considerations, to marking by any nonuniformity in the fabric or fabrics.

Despite the considerable technical obstacles presented by these requirements, it remained highly desirable to develop an on-machine-seamable fabric because of the comparative ease and safety with which such a fabric could be installed. Ultimately, the development of fabrics having seams formed by providing seaming loops on the crosswise edges of the two ends of the fabric was achieved. The seaming loops themselves are formed by the machine-direction (MD) yarns of the fabric. The seam is closed by bringing the two ends of the fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an on-machine-seamable fabric, than it is to install an endless fabric, on a paper machine.

One method to produce a fabric that can be joined on the paper machine with such a seam is to flat-weave the fabric. In this case, the warp yarns are the machine-direction (MD) yarns of the fabric. To form the seaming loops, the warp yarns at the ends of the fabric are turned back and woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the fabric, is continuous, the seaming loops obtained in this manner are stronger than any that can be produced by weaving the warp ends back into the ends of a flat-woven fabric.

A final step in the manufacture of an on-machine-seamable fabric used as a press fabric is to needle one or more layers of staple fiber material into at least the outer surface thereof. The needling is carried out with the fabric joined into the form of an endless loop. The seam region of the fabric is covered by the needling process to ensure that that region has properties as close as possible to those of the rest of the fabric. At the conclusion of the needling process, the pintle which joins the two ends of the fabric to one another is removed and the staple fiber material in the seam region is cut to produce a flap covering that region. The fabric, now in open-ended form, is then crated and shipped to a paper-manufacturing customer.

Industrial fabrics are typically made by the steps of weaving, heatsetting and optional seaming. During the weaving step, a raw material such as, for example, monofilament is typically either woven into "flat," or rectangular shaped fabric, or else woven as endless, or "loop" fabrics. Thereafter a heatsetting step and then a seaming step usually follow. Seaming requires that opposing ends of the fabric be configured in some fashion to create a seam, such as a pin seam or pin spiral seam.

It is desirable, however, to manufacture an industrial textile fabric in a manner other than the conventional weaving, heatsetting and optional seaming steps.

SUMMARY OF THE INVENTION

It is therefore a principal object of the present invention to provide an industrial textile product that, although referred to as a fabric, is not produced by weaving or knitting.

It is a further object of the invention to provide a method for producing industrial fabrics with or without a seam for papermaking and other applications.

These and other objects and advantages are provided by the present invention. In this regard, the invention is directed towards spirally winding an array of yarns and connecting the yarns in the CD direction with resin. An embodiment of the product formed has a seam. This method is a replacement for conventional weaving or knitting of substrates which can be used as forming, press or dryer fabrics in papermaking; nonwovens production by hydroentangling (wet process), meltblowing, spunbonding, and airlaid needle punching; corrugated cardboard production; tissue and towel products made by through-air drying processes; the production of wetlaid and drylaid pulp; and processes related to papermaking such as those using sludge filters, and chemiwashers.

A methodology for the production of the inventive fabric is also described herein. First, a system of machine direction (MD) yarns, such as monofilaments, is spirally wound either endless or seamable using a device comprising two parallel rolls horizontally mounted and, in the case where a seam is to be formed, further comprising a "turn around" fixture. Second, CD elements are created directly on the system of MD yarns by depositing a polymer orthogonally thereto on one or both surfaces thereof. The CD elements act as connectors to lock and stabilize the overall structure. They can be the full width of the fabric or extend for shorter lengths. The polymer is deposited using a jet(s) or other means suitable for the purpose and described herein.

BRIEF DESCRIPTION OF THE DRAWINGS

Thus by the present invention, its objects and advantages will be realized, the description of which should be taken in conjunction with the drawings wherein.

DETAILED DESCRIPTION OF THE PREFERRED EMBODIMENTS

Figure 4:
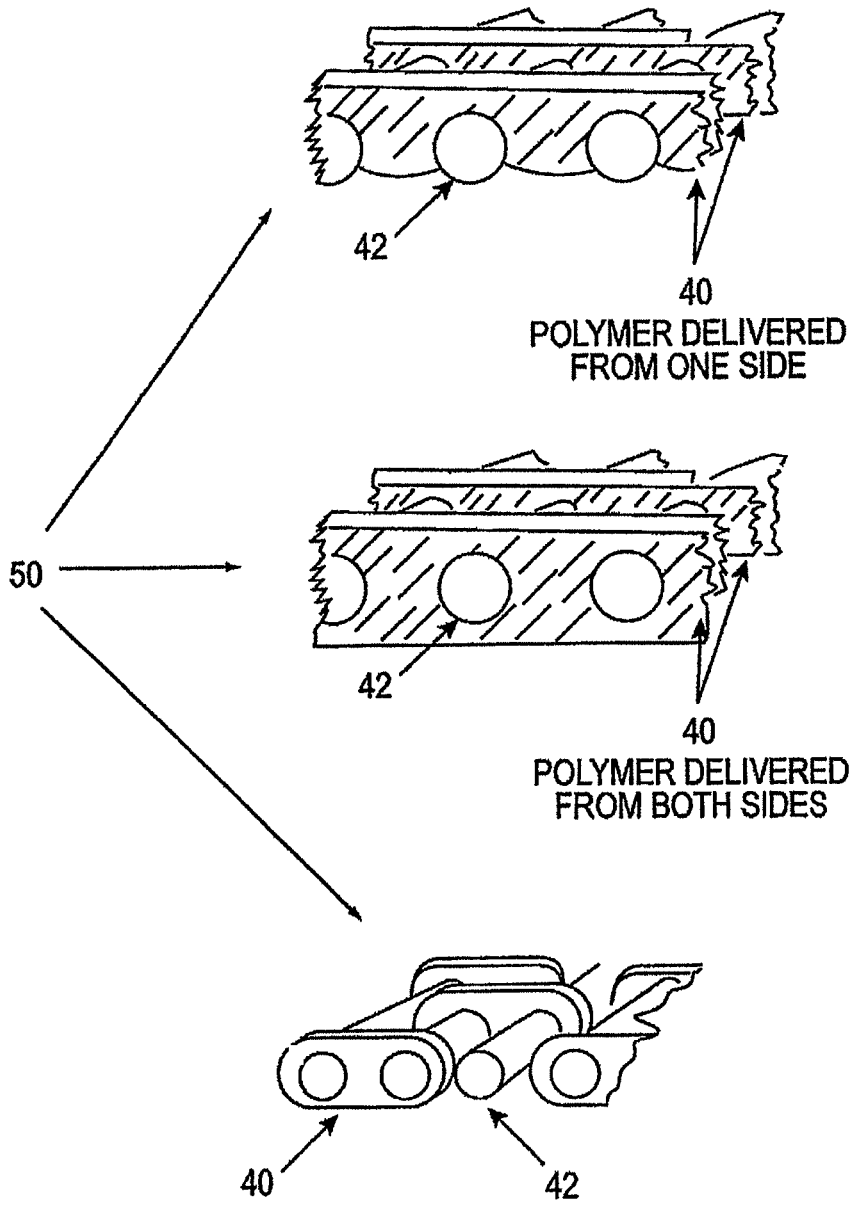
FIG. 4 is a perspective view showing portions of the industrial textile fabric of the invention.

Turning now more particularly to the drawings, FIG. 4 shows portions of the industrial textile fabric 50 according to the present invention. Advantageously, the fabric 50 is formed by spirally winding an array of yarns and connecting the yarns in the CD direction with resin. This method is a replacement for conventional weaving or knitting. As can be seen, the textile structure 50 comprises a system of CD elements 40 created directly on a system of MD yarns 42. These CD elements 40 may be formed, for example, by depositing a polymer orthogonally on one or both surfaces of a system of MD yarns 42. In this way, the CD elements 40 act as connectors to lock and stabilize the overall structure 50. As can be seen, the CD elements 40 can extend either the full width of the structure 50, or also for shorter lengths. In addition, the CD elements 40 do not encapsulate the MD yarns 42 along the entire length thereof, but rather provide only local encapsulation. Also, it is noted that the MD yarns 42 can comprise, for example, polyethylene terephthalate, polyamide; other polymers suitable for the purpose, or even other material such as metal, if suitable for the purpose. In addition, the MD yarns 42 can take on various shapes such as round, square, rectangular, oblong, lobed and other shapes suitable for the purpose. Obviously, the CD elements 40 can be shaped as desired. Also, while monofilament yarns are used as examples herein, yarns such as multifilaments, bicomponent and other types known to those skilled in the art and suitable for the purpose may also be used.

Advantageously, the CD elements 40 fix the position of the MD yarns 42 to produce a stable structure 50 that functions as a woven or knitted fabric would whilst also having, in certain respects, properties superior to those of a woven or knitted product. For example, MD yarn spacing is no longer controlled by weaving around CD yarns, so MD yarns can be infinitely spaced apart or close together. If the inventive product is to be used as an embossing fabric in the production of tissue or towel, or in the production of textured nonwovens, another important advantage provided is the production of fabrics 50 with patterns. Such patterning is achieved, for example, by controlling the deposition of the CD elements 40 onto the MD yarn system 42, such as by speeding up or slowing down the delivery of the polymer so to leave more or less polymer in certain areas. So instead of having to deposit a resin in a designed pattern on a woven fabric, both the fabric production and patterns are achieved simultaneously.

Figure 1:
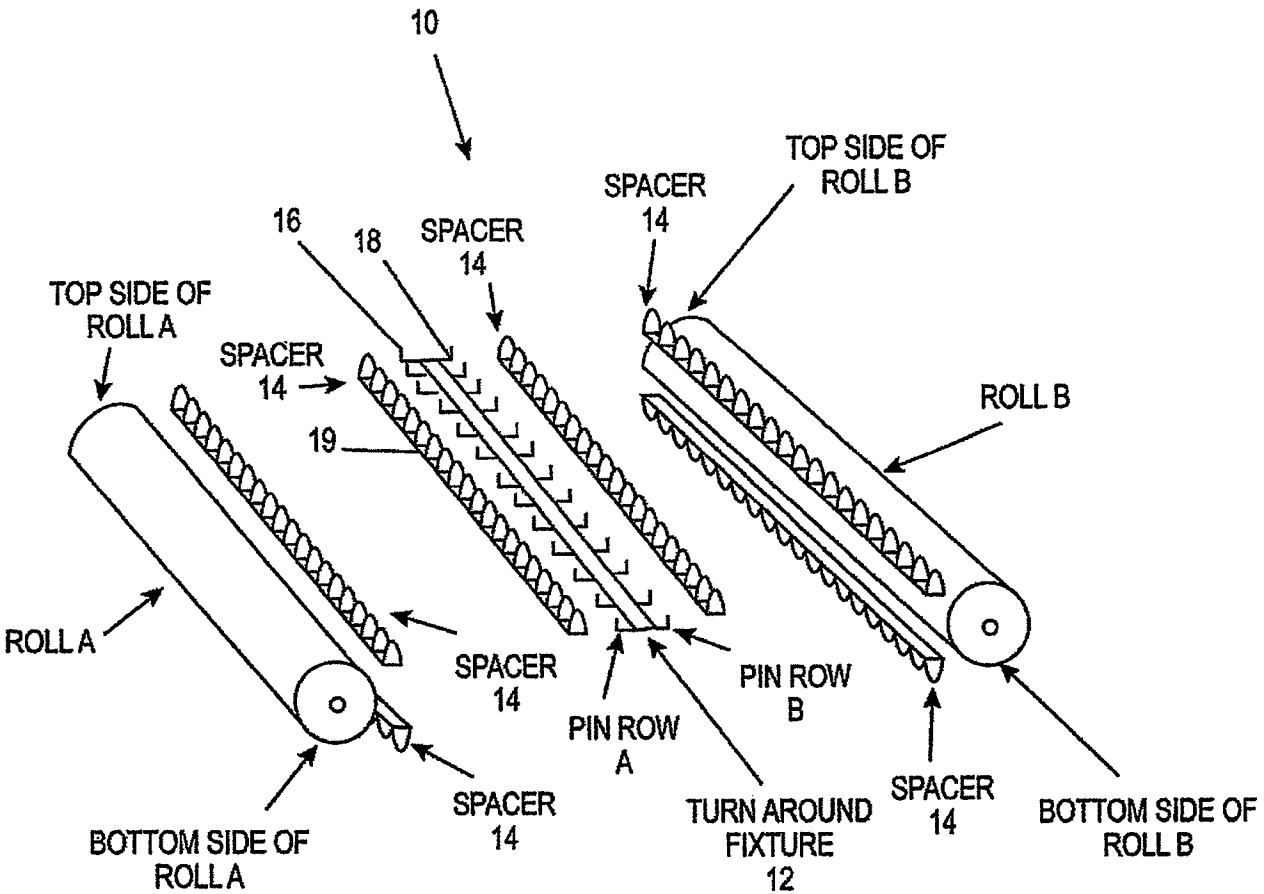
FIG. 1 is a perspective view of a device used to spirally wind the MD yarns, according to the present invention.

The first step in producing the textile 50 of the invention is to spirally wind the system of MD yarns 42 using a device 10 such as that shown in FIG. 1. However, note that in one embodiment of the invention, an endless product is produced by eliminating the "turn around" fixture 12. In this case, the MD yarns are wound or wrapped around the two parallel rolls A and B to create a system of MD yarns 42 without a seam. A similar process is described in U.S. Pat. No. 4,495,680 to Best. (See also, e.g., U.S. Pat. No. 3,097,413 to Draper) That is, the '680 patent shows a method and apparatus for forming a base fabric composed solely of MD yarns to be used in making a papermaker's felt. Essentially, the MD yarns are helically wound about two parallel rolls. Subsequently, fibrous batting or other nonwoven material is applied and adhered to the helical array of MD yarns to provide a "fillingless" papermaker's felt, which is to say that it has no cross-direction yarns.

In a further embodiment of the present invention where instead a seamed product is produced, the device 10 comprises the two parallel rolls and also the "turn around" fixture 12. (See also, e.g., U.S. Pat. No. 6,491,794 B2 to Davenport for an alternative example of the rolls used for fabricating a seamable array). Rolls A and B are preferably mounted horizontally, and are similar to the steel rolls used in conventional heatsetting of dryer fabrics, although there is no requirement that rolls A and B be heated. The turn around fixture 12 is positioned in parallel between the rolls, in the plane formed by the top surfaces of the rolls. This turn around fixture 12 includes two rows of pins, pin row A and pin row B. The pins provide a "turn around" for the yarns that will eventually form the seam from the MD yarns 42 at the ends of structure 50.

Employing the device 10, one or more large spools (not shown) of monofilaments, for example, are used in creating a system of MD yarns and a seam at the two ends thereof, by means of a wrapping process. Initially, one end of the spool of monofilament is tied or otherwise attached to a pin 16 at the far end of pin row A. This monofilament is then unwound at a controlled tension and travels perpendicular to the rolls towards roll A. The monofilament first contacts the top side of roll A, wraps 180 degrees therearound, and contacts the bottom side of roll A. The monofilament then travels to roll B, first contacting the bottom side of roll B, wrapping 180 degrees therearound, and contacting the top side of roll B. The monofilament then travels to the pin 18 at the far end of pin row B. Note that pin 18 is opposite the pin 16 in pin row A upon which the monofilament was attached at the start of this process. Note further that during the wrapping process, the monofilament is preferably maintained in a direction perpendicular to the rolls, although there may be a small or slight angle of wrap. In this connection, spacers 14 can be positioned near the pins and near the top and bottom sides of each roll to facilitate parallel positioning and spacing of the monofilaments as they are wrapped.

Upon reaching the pin 18, the monofilament is lopped over or around pin 18, and is unwound again toward roll B. The monofilament first contacts the top side of roll B, is wrapped 180 degrees therearound, and contacts the bottom side of roll B. The monofilament is then further unwound as it is brought to roll A. The monofilament first contacts the bottom side of roll A, is then wrapped 180 degrees therearound and contacts the top of roll A. The monofilament is then unwound towards the pin 19 in pin row A. Note that pin 19 is adjacent to the pin 16 that the monofilament was attached to at the start of the wrapping process. The monofilament is wrapped around pin 19 and the wrapping process is repeated until a system of MD yarns 42 is constructed having a width equal to the desired width of the end structure 50.

Figure 2:
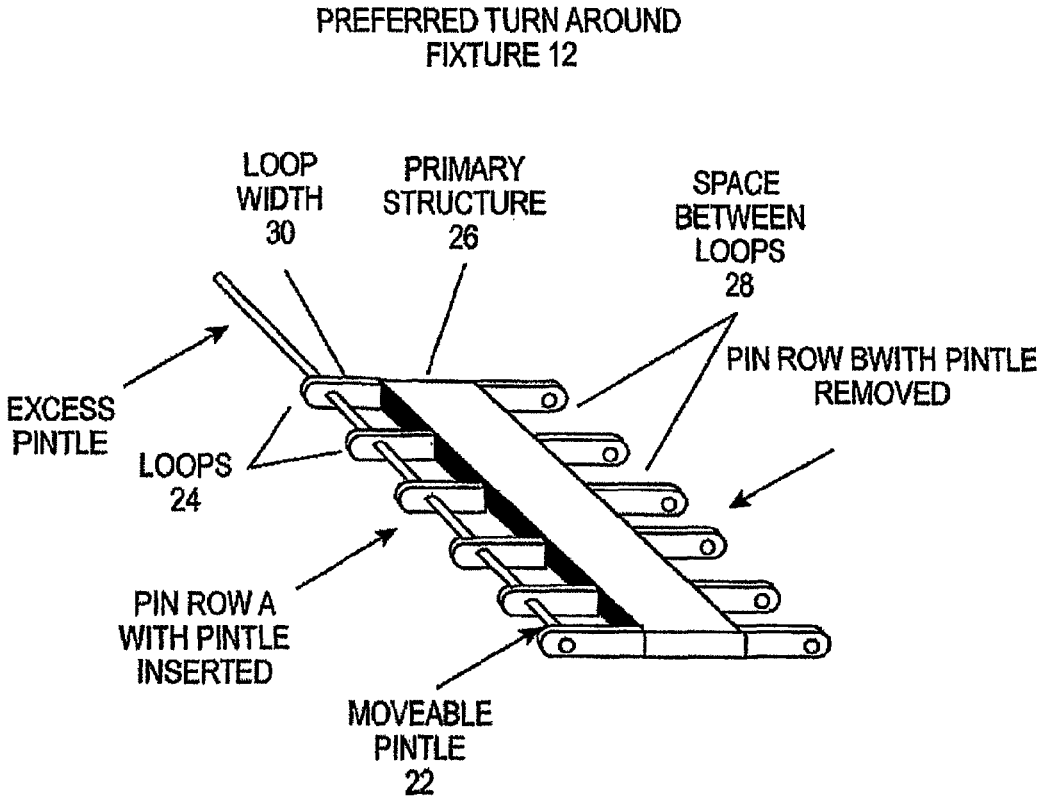
FIG. 2 is a perspective view of a preferred turn around fixture, in accordance with the teachings of the invention.

FIG. 2 illustrates a turn around fixture 12 having a preferred system of pins. This system comprises a moveable pintle 22 that slides through a series of parallel loops 24 that are contiguous with the primary structure 26. Shown in FIG. 2 are pin row A with the pintle 22 inserted, and pin row B with the pintle 22 removed. Note that the spaces 28 between the loops 24 facilitate the positioning of the monofilament (not shown) that is to be wrapped. It is further noted that the loop width 30 determines the space available for a loop of monofilament that will make up the other half of the seam coming from the opposite direction. In this connection, the loop width 30 is typically equal to or greater than the width of the monofilament. However, the loop width can also be smaller, in which case accommodation must be made for fitting the monofilament loops into the available space in the seam.

The pin system shown in FIG. 2 functions as follows. As a monofilament is brought up to the desired pin location, it is placed between two parallel loops 24 in the primary structure 26. The pintle 22 is then slid forward so as to engage, or capture, the monofilament. The pin system shown in FIG. 2 is preferred since it allows for positioning the monofilaments that form the seam in the configuration preferred in the finished textile product.

Figure 3:
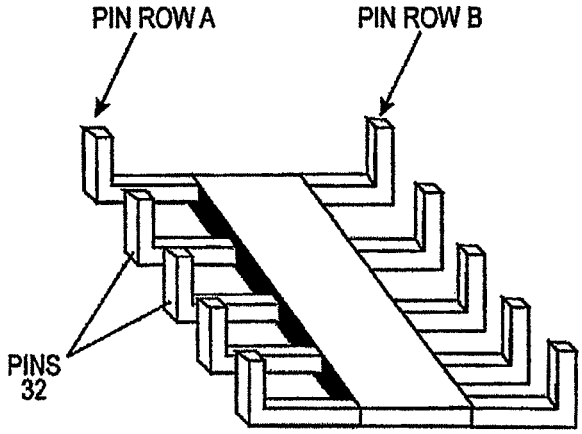
FIG. 3 is a perspective view of an alternative turn around fixture, incorporating the teachings of the present invention.
Figure 3:
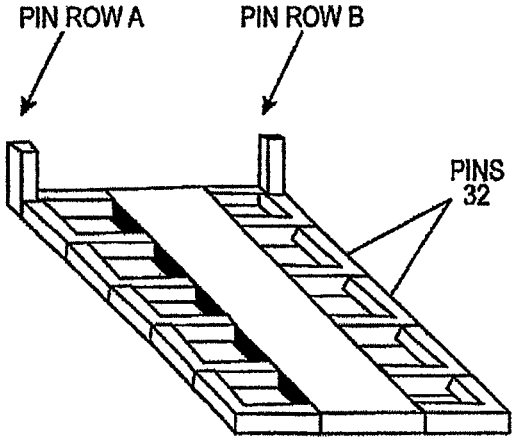

FIG. 3 illustrates an alternative turn around fixture 12 having pin rows A and B. As can be seen, the pins 32 are mounted vertically but can be rotated individually or in groups into a horizontal position. When a pin 32 is in the vertical position, the monofilament can be readily placed over pin 32 or removed therefrom. On the other hand, when the pin 32 has been rotated into the horizontal position, the monofilament is locked, or captured, around the pin 32. After rotation of the pin 32 to the horizontal position, the monofilament is then in the preferred position for the finished seam.

After a system of MD yarns has been assembled, the next step is to form a system of CD elements 40 on the MD yarn system, as shown in FIG. 4. One means of creating a system of CD elements 40 is by utilizing a polymer deposition device such as a piezo jet or jets dispensing a curable polymer in a CD direction onto and between the MD yarns 42. Subsequently, curing the polymer (by, for example, UV light or heat) results in a solid system of CD elements 40. Note that the polymer can be delivered to one or both surfaces of the system of MD yarns 42. In the case where the polymer is delivered to both surfaces, the polymers from each surface join and subsequently bond where they meet.

Advantageously, the CD elements 40 contribute to fabric stability and other functional characteristics such as permeability to air and/or water, structural void volume, caliper and the like. A further advantage is that that the polymers used as the CD element material can be ones not easily extruded into stable monofilaments. As yet a further benefit, the CD elements 40 acts as "shute runners" on the wear side of the structure 50, protecting the level having MD yarns 42. In this connection, high abrasion resistant polymers can be used as the CD element material considerably improving fabric wear resistance.

Means for forming the CD elements 40 other than by jet dispensing include a polymer melt process, and a curable polymer process. With the former process, molten polymer is metered in a CD direction onto and between the MD yarns 42. Thereafter, the molten polymer cools and solidifies into a system of CD elements 40. In the latter process, curable polymer is metered onto and between the MD yarns 42 in a CD direction. The subsequent curing of the polymer results in a solid system of CD elements 40. With both methods, the polymer can be delivered to one or both surfaces of the system of MD yarns 42. In the case where the polymer is delivered to both surfaces, the joining and subsequent bonding of the polymer optimizes the product stability.

Another method for creating a system of CD elements 40, called Fused Deposition Modeling ("FDM"), uses monofilament as a feedstock. With this method, the monofilament is melted and the molten polymer is delivered as a metered stream onto the system of MD yarns 42. The polymer subsequently cools, resulting in a solid system of CD elements 40. Again, the polymer can be delivered to one surface of the MD yarns 42, or to both surfaces, in which case the joining and subsequent bonding of the polymer is desired to optimize the end structure 50 stability.

A further method for forming the system of CD elements 40 is to fuse and bond monofilaments that are positioned as CD elements 40. With this method, the "CD monofilaments" are first positioned, either singularly or in groups, next to or touching the system of MD yarns 42. The CD monofilaments are then heated so they distort and mechanically interlock with the MD yarns 42. Subsequently, the CD monofilaments cool into a solid system of CD elements 40. Note that the CD monofilaments can be initially positioned on one, or preferably both, surfaces of the system of MD yarns 42. When positioned on both surfaces, the CD monofilament from each surface distort so to be joined and bonded where they meet near the center in the thickness direction of the structure 50. This produces an end structure 50 with excellent stability. It is noted that a polymer particularly suitable for the CD elements is MXD6, or poly-m-xylylene adipamide. This polymer in monofilament form has an unusual ability to bond to itself without losing substantial functional strength as a CD yarn. Alternatively, bicomponent monofilaments comprising, for example, a sheath having a melting point lower than the core, can be used. Such monofilaments can be used in the CD or MD direction alone, or preferably in both directions, since this results in the strongest bonding and the best stabilized end structure 50.

For the seamed version of the invention, note that after the system of CD direction elements 40 has been created, the pintle 22 in the turn around fixture 12 are removed and the structure 50 is ready for installation. Such installation is achieved by joining or meshing together the two ends of the fabric that contain loops and then inserting a new pintle 22 in the meshed loops to create an endless fabric.

Incidentally, it is noted that where the structure 50 is for use as a press fabric or corrugator belt, batt is usually added to one or both sides. In addition, other nonwovens can be laminated to the structure 50 with or without batt. Note further that the edges of the structure 50 must be trimmed parallel to the machine direction (MD).

The aforesaid invention allows for versatility in creating the structure 50. For example, if the structure 50 is to be permeable, the openness of the structure 50 can be adjusted by the widthwise thickness of CD elements. If it is desirable to have a smooth sheet contact side in a situation where sheet marking is a concern) the vertical thickness of the CD elements may be formed equal to that of the MD yarns 42. If the structure 50 is to be impermeable, it can be coated or impregnated with a resin and otherwise processed.

Thus by the present invention its objects and advantages are realized, and although preferred embodiments have been disclosed and described in detail herein, its scope and objects should not be limited thereby; rather its scope should be determined by that of the appended claims.

What is claimed is:

1. A method for forming a textile structure comprising the steps of:

spiral winding machine direction (MD) yarns to form a system having a defined width;

depositing a pattern of cross machine direction (CD) elements onto said system of MD yarns, wherein said CD elements do not encapsulate the MD yarns along the entire length thereof; and curing said CD elements to obtain a solid system of CD elements.

2. The method of claim 1, wherein the CD elements connect the MD yarns so as to fix their position and stabilize the structure.

3. The method of claim 1, wherein the MD yarns are intermittently encapsulated by the CD elements along the length of the MD yarns.

4. The method of claim 1, wherein the CD elements extend the full width of said MD yarn system.

5. The method of claim 1, wherein the CD elements extend less than the full width of said MD yarn system.

6. The method of claim 1, wherein the textile structure formed is a forming, press, dryer, TAD, pulp forming, sludge filter, chemiwasher, or engineered fabric.

7. The method of claim 1, wherein said CD elements are created on said MD yarn system by depositing a polymer resin orthogonally thereto on one or both surfaces thereof so as to obtain a system of CD elements interlocking with the MD yarns.

8. The method of claim 7, wherein the pattern created on the MD yarn system is varied by controlling said deposition of said polymer thereon.

9. The method of claim 8, wherein a speed of said deposition is controlled so as to adjust the amount of polymer deposited on said MD yarn system.

10. The method of claim 7, wherein the polymer is delivered using one or more dispensers.

11. The method of claim 7, wherein the polymer is delivered to both surfaces of the MD yarn system so as to join and subsequently bond the MD yarn system therebetween.

12. The method of claim 7, wherein the deposited polymer is curable by one of UV light or heat.

13. The method of claim 7, wherein the deposited polymer is molten polymer and is subsequently cooled to obtain a solid system of CD elements.

14. The method of claim 13, wherein the molten polymer is derived by melting monofilament used as feedstock.

15. The method of claim 7, wherein said polymer is one of MXD6 and poly-m-xylylene adipamide.

16. The method of claim 1, wherein the textile structure formed is on-machine-seamable or endless.

17. The method of claim 1, wherein the MD yarns are capable of being infinitely spaced apart or close together.

18. The method of claim 1, wherein the CD elements contribute to fabric stability and other functional characteristics such as permeability to air and/or water, structural void volume or caliper.

19. The method of claim 1, wherein the CD elements acts as shute runners on a wear side of the structure, protecting the MD yarns.

20. The method of claim 1, wherein high abrasion resistant polymers are used as the CD element material.

21. The method of claim 1, wherein a layer of batt is affixed to one or both sides of the structure.

22. The method of claim 1, wherein one or more nonwoven layers are laminated to the textile structure with or without batt.

23. The method of claim 1, wherein the textile structure is permeable.

24. The method of claim 1, wherein said textile structure has a smooth sheet contact side.

25. The method of claim 1, which includes a resin coating rendering said textile structure impermeable.

* * * * *